United States Patent [19]

Junkman et al.

[11] Patent Number: 4,887,729

[45] Date of Patent: Dec. 19, 1989

[54] CUP FOR HANDICAPPED PERSONS

[76] Inventors: John W. Junkman, 1000 W. 1st St., Hastings, Minn. 55033; Florence F. Junkman, Herbster, Wis. 54844

[21] Appl. No.: 226,439

[22] Filed: Aug. 1, 1988

[51] Int. Cl.[4] ..... A47G 19/22

[52] U.S. Cl. ..... 215/100 A; 215/1 R; 220/94 A

[58] Field of Search ..... 215/100 R, 100 A, 6, 215/1 A; 220/94 A, 94 R; D7/9, 10

[56] References Cited

U.S. PATENT DOCUMENTS

| | | | |
|---|---|---|---|
| D. 37,168 | 10/1904 | Moller, Jr. . | |
| D. 148,580 | 2/1948 | Ross . | |
| D. 166,832 | 5/1952 | Thompson | 220/94 R X |
| D. 191,214 | 8/1961 | Fisher | D7/10 |
| D. 197,528 | 2/1964 | Carroll . | |
| D. 264,663 | 6/1982 | Ochwat . | |
| D. 279,752 | 7/1985 | Jagger | D7/10 |
| 1,674,452 | 6/1928 | Slick | 220/94 A |
| 1,934,156 | 11/1933 | Verderosa . | |
| 1,941,327 | 12/1933 | Turner | 215/6 |
| 2,057,047 | 10/1936 | Myer | 220/94 A |
| 2,586,199 | 2/1952 | Backus | 220/94 A |
| 2,661,609 | 12/1953 | Reuell | 220/94 A |
| 4,220,079 | 9/1980 | Sims | 215/1 R X |
| 4,557,392 | 12/1985 | Ryan et al. | 215/100 A X |

FOREIGN PATENT DOCUMENTS

| | | | |
|---|---|---|---|
| 7601681 | 8/1976 | Netherlands | 215/100 A |
| 264868 | 3/1928 | United Kingdom | 220/94 A |

OTHER PUBLICATIONS

Feeding Cup, The Vollrath Co., Health Care Division, 209 Vollrath Drive, P.O. Box 228, Gallaway, TN 38036, Medical Care Prod., 4/1988.

*Primary Examiner*—Sue A. Weaver

*Attorney, Agent, or Firm*—Peterson, Wicks, Nemer & Kamrath

[57] ABSTRACT

The receptacle is in the form of a cup having U-shaped handles extending laterally in opposite directions. The handles also incline upwardly and forwardly. Oriented with respect to the handles are two thumb rests that are engagable by the user's thumbs when the user's fingers are grasping the U-shaped handles. In this way, a handicapped person can firmly grasp the handles and thumb rests so as to manipulate the cup without assistance.

6 Claims, 1 Drawing Sheet

CUP FOR HANDICAPPED PERSONS

BACKGROUND

This invention relates generally to drinking cups, and pertains more particularly to a cup having handles and thumb rests that may be firmly grasped and held by persons afflicted with various handicaps that make it difficult for such individuals to use conventional cups and the like.

A number of receptacles which include cups and mugs exist that are fabricated with various types of handles, sometimes for ornamental reasons and sometimes to facilitate the handling of such receptacles. Virtually any type of receptacle with two handles makes it easier for the person to use such a receptacle. However, persons with severely impaired hands simply cannot manipulate such receptacles or vessels properly by themselves, frequently requiring assistance. As just stated, virtually any handle will make it easier for an individual to properly manipulate a receptacle, such as a cup or a mug. Nonetheless, there still remains a very real need for a cup or the like that can be used by individuals with limited dexterity and/or strength as the result of age, disease, injury, or illness and for such handicapped persons to stabilize and hold the cup firmly.

SUMMARY OF THE INVENTION

Accordingly, an important object of the present invention is to provide a receptacle in the form of a cup or a mug that can be readily handled by a greater number of individuals with various handicaps, doing so without assistance from others. More specifically, an aim of the invention is to provide a cup with laterally extending or issuing thumb rests that are oriented with respect to rearwardly sloping handles so that the receptacle can be firmly grasped by both hands of the individual even though that person's hands are physically impaired or lacking motor capability for one reason or the other.

Another object of the present invention is to provide a cup or the like that possesses the above-mentioned capability and which capability is enhanced by the cup being extremely light weight.

Yet another object of the present invention is to provide a cup for handicapped persons that will be long-lasting, being virtually indestructible by virtue of its rugged construction.

Still another object of the present invention is to provide a cup possessing the above attributes that can be manufactured and sold at a relatively low price, thereby encouraging its use in private homes, nursing homes, hospitals and even restaurants catering to persons with various handicaps.

The present invention has for another object the helping of impaired persons to regain confidence in that a cup fabricated in accordance with the present invention can be handled with considerable ease, thereby creating a sense of self-reliance that would not otherwise exist.

Briefly, the present invention envisions a receptacle in the form of a cup or the like that has oppositely issuing U-shaped or looped handles that are appropriately inclined relative to a pair of thumb rests so that a person lacking either dexterity or strength may grip both the handles and the thumb rests in a manner so that the cup can be manipulated without assistance from third persons.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
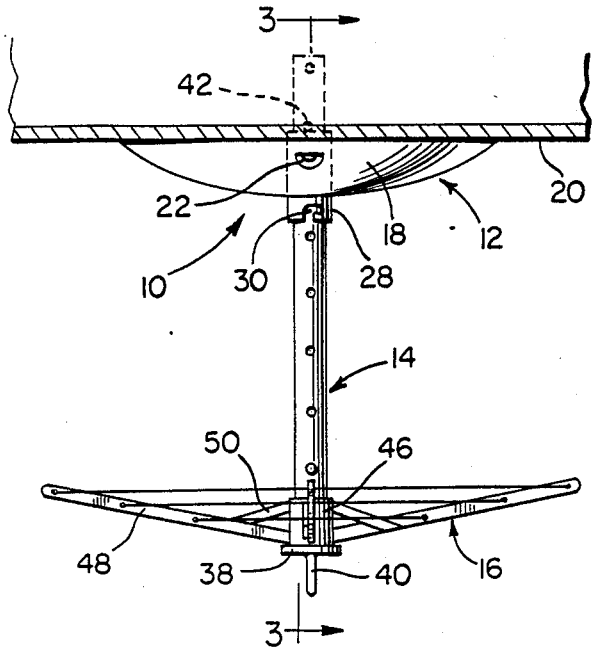
FIG. 1 is a perspective view illustrating a cup being actually used by a person according to the preferred teachings of the present invention.
Figure 2:
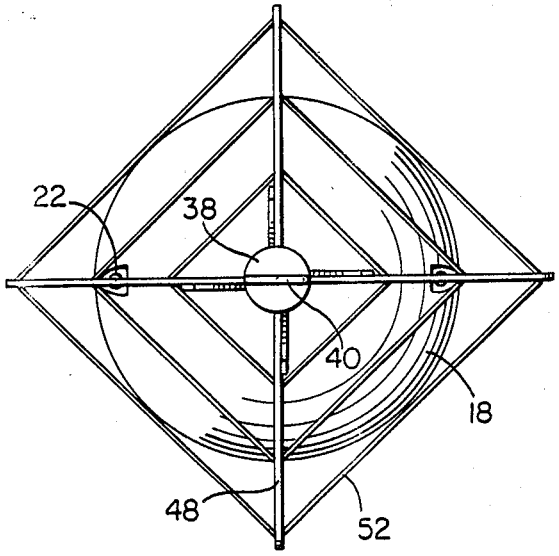
FIG. 2 is a front elevational view of the cup of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "upper", "side", "edge", "bottom", and similar terms are used herein, it should be understood that these terms have reference only to the structure shown in the drawings as it would appear to a person viewing the drawings and are utilized only to facilitate describing the invention.

DESCRIPTION OF THE PREFERRED EMBODIMENT

While the present invention will possess utility as far as several types of receptacles are concerned, such as cups, mugs, and pitchers, it will be convenient to illustrate the present invention in the form of a drinking cup. With this in mind, FIG. 1 depicts a preferred form of a cup 10 in actual use by a person with impaired hands. Cup 10 comprises a bottom wall 12 and an upstanding cylindrical side wall 14, thereby forming a recess 16. The upper edge of the side wall 14 provides a lip 18. While the commercial embodiment makes use of a thermal liner that is integrally held within the recess 16, inasmuch as the liner does not play a role in the practicing of the present invention it is somewhat easier to illustrate the cup 10 without the liner being shown.

At this time attention is directed to a pair of U-shaped or looped handles 20 that extend laterally from opposite sides of the side wall 14. Handles 20 are of a size allowing relatively large fingers with swollen joints to easily grasp and firmly hold cup 10. It will help in appreciating the benefits to be derived from the present invention to consider the handles 20 as each having a leg portion 22, a leg portion 24, and a bight portion 26. Each leg portion 22 is attached at 28 to the side wall 14; also, each leg portion 24 is attached at 30 to the side wall 14. It will be understood that when fabricating the cup 10, these leg portions 22 and 24 are integrally molded when forming the bottom wall 12 and the side wall 14.

Figure 4:
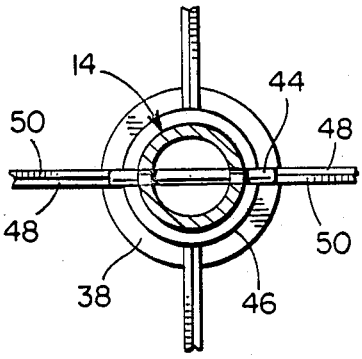
FIG. 4 is a side elevational view of the cup of FIG. 1.
Figure 1:
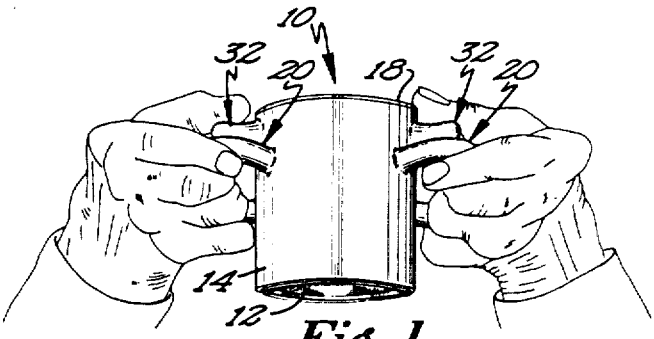
Figure 2:
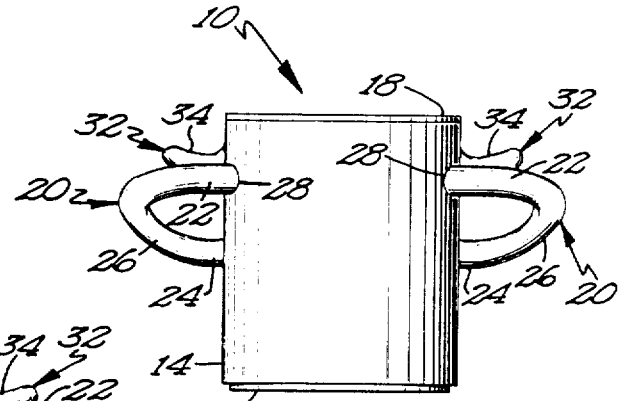
Figure 3:
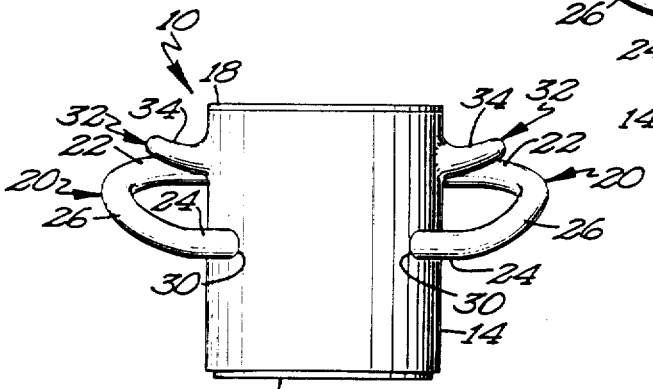
Figure 4:
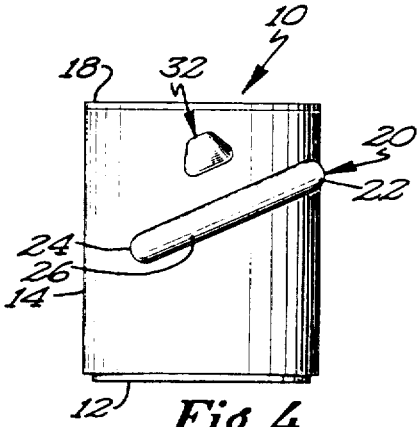
Figure 5:
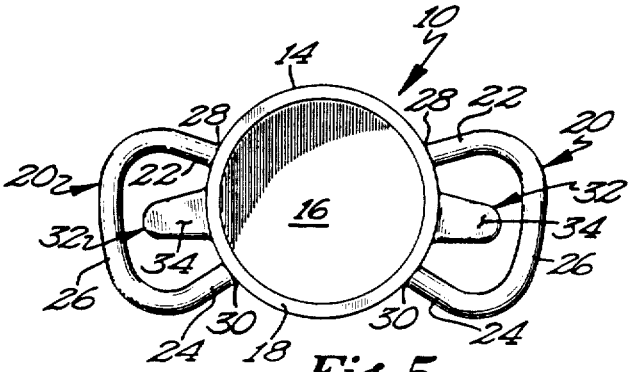
FIG. 5 is a top plan view of the cup of FIG. 1.

As can be clearly appreciated from FIG. 4, the point of attachment 30 for the leg portion 24 is in each instance lower or nearer the bottom wall 12 than is the point of attachment 28 for each of the leg portions 22. Thus, it will be discerned that the U-shaped handles 20, as viewed in FIG. 4, are in a backward slanted position and specifically incline upwardly and forwardly away from the person depicted in FIG. 1.

Figure 3:
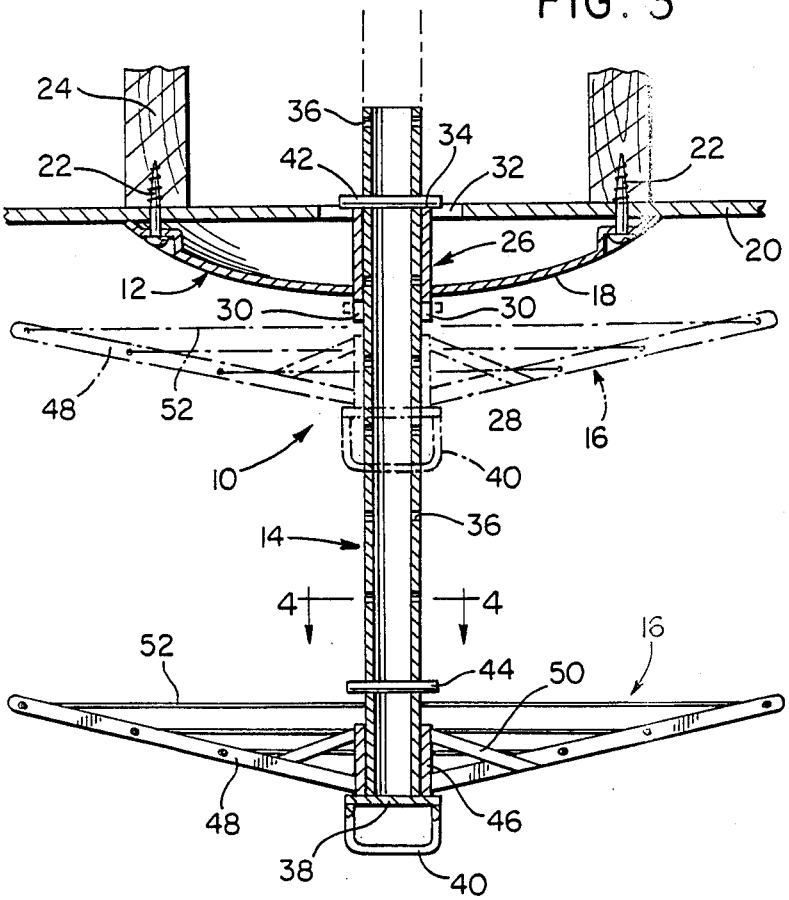
FIG. 3 is a rear elevational view of the cup of FIG. 1.

Playing a very important role in the practicing of the present invention is a pair of thumb rests 32, these thumb rests 32 being integrally molded to the side wall 14. The thumb rests 32 constitute oppositely or laterally issuing ears. From FIG. 3 it will be seen that the thumb rests 32 incline outwardly and upwardly, forming upwardly curving top surfaces 34, whereas from FIG. 4 it will be observed that the thumb rests 32 also incline upwardly and forwardly. Also, from FIG. 4 close inspection will show that the thumb rests 32 are somewhat nearer the leg portions 22 than the leg portions 24. Actually, the curved top surface 34 is at an elevation slightly above the leg portions 22 in each instance.

In its most preferred form, cup 10 is molded from durable plastic which is lightweight, non-breakable, chip resistant, and dishwasher safe to provide years of regular use. Cup 10 should be formed without seams or raw edges which could potentially injure a sensitive hand. The base of cup 10 may be slightly weighted to enhance spill-resistant qualities.

Having presented the foregoing description, the benefits to be derived from using cup 10 according to the present invention should be clear. It might be pointed out that cup 10 will find considerable utility by persons of any age from a youngster to the aged having various medical conditions. Perhaps arthritis constitutes a physical condition where persons so afflicted can readily make an optimum use of cup 10. However, other handicapped persons, such as are those who have suffered a stroke and those handicapped by a number of different paralyzing diseases, will find the present invention extremely helpful. It will also be appreciated that small children will be able to manipulate the cup 10; actually the cup 10 can serve as an excellent training medium for small children, enabling them to more rapidly graduate to cups of conventional designs.

What is important to realize is that the user's thumbs can be readily placed on the top surfaces 34 of the two thumb rests 32 and a relatively wide choice of how the handles are to be gripped is left up to the individual person, depending to a large extent on the impairment of that person's hands. For instance, the person's fore fingers can contact or engage the forward surfaces of the leg portions 22 while other fingers simply underlie the bight portions 26 and to whatever degree under the leg portions 24. The looped configuration of the handles 20 permit the user to insert one or more fingers upwardly through the openings formed by the handles 20. Thus, the finger joints may be protected and used to their greatest mechanical advantage by handles 20 and thumb rests 32 of cup 10 according to the teachings of the present invention.

It can be appreciated that anything which can be poured such as hot or cold beverages, soups, thinned cereals, thinned pureed foods, milk shakes, liquid nutritional supplements, and the like can be consumed from cup 10 according to the teachings of the present invention.

It can also be appreciated that cup 10 allows grasping from both sides by both hands and thumbs of the user according to the teachings of the present invention for adding the stabilization often necessary to bring the full cup to the mouth unassisted and with a minimal degree of spillage. Thus, many handicapped individuals not having the strength and/or manual dexterity in either hand alone and previously requiring assistance in using a regular drinking cup or glass from a care-giver, whether in a home setting or a health care facility, may drink unassisted without fears of dropping or spilling. Thus, care-giver time is reduced and especially in a health care setting, the less staff time required, the more money is saved. But more importantly, the handicapped individual gains additional independence, dignity, and freedom and improves their feelings of self-worth.

What should be appreciated is that considerable leeway exists for differently handicapped persons to make considerable use of cup 10 according to the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A receptacle comprising, in combination: a cup-shaped member including a bottom wall and an upstanding side wall forming a recess, a pair of handle members issuing laterally in generally opposite directions from said side wall, said handle members being generally U-shaped, the U-shaped handle members each having first and second leg portions and bight portions, said handle members being of a size and inclined with the first leg portion thereof of each handle member nearer to said bottom wall than the second leg portion permitting the upward insertion of one or more fingers through the handle members, and a pair of thumb rest members also issuing laterally from generally opposite positions from said side wall, said thumb rest members being oriented relative to said handle members so as to be engagable by a person's thumbs when other fingers of the person's hands are engaging the handle members, said thumb rest members located at an elevation on the side wall above said first leg portion of said handle members and spaced laterally between said first and second leg portions.

2. A receptacle in accordance with claim 1 in which said thumb rest members are in the form of oppositely issuing ears extending from the side wall a distance generally equal to the distance that the first and second leg portions extend from the side wall.

3. A receptacle in accordance with claim 2 in which the vertical extent of said thumb rest members is at substantially the same elevation as said second leg portions.

4. A receptacle in accordance with claim 3 in which said thumb rest members extend outwardly from said side wall at the generally opposite positions and incline upwardly from the generally opposite positions as the thumb rest members extend outwardly from the generally opposite positions.

5. A receptacle in accordance with claim 4 in which said thumb rest members include upper surfaces which curve upwardly with respect to the generally opposite positions of said side wall as the thumb rest members extend outwardly from the generally opposite positions.

6. A receptacle in accordance with claim 5 in which said thumb rest members have a length which is substantially smaller than the length of the bight portions and are located nearer said second leg portions than said first leg portions.

* * * * *

UNITED STATES PATENT AND TRADEMARK OFFICE

CERTIFICATE OF CORRECTION

PATENT NO. : 4,887,729

DATED : Dec. 19, 1989

INVENTOR(S) : John W. Junkman, et al.

It is certified that error appears in the above-identified patent and that said Letters Patent is hereby corrected as shown below:

The title page showing the illustrative figure should be deleted to be replaced with the attached title page.

The sheet of drawings should be deleted to be replaced with the sheet of drawings as shown on the attached sheet.

Signed and Sealed this

Fifth Day of February, 1991

*Attest:*

HARRY F. MANBECK, JR.

*Attesting Officer*

*Commissioner of Patents and Trademarks*

United States Patent [19]

Junkman et al.

[11] Patent Number: 4,887,729

[45] Date of Patent: Dec. 19, 1989

[54] CUP FOR HANDICAPPED PERSONS

[76] Inventors: John W. Junkman, 1000 W. 1st St., Hastings, Minn. 55033; Florence F. Junkman, Herbster, Wis. 54844

[21] Appl. No.: 226,439

[22] Filed: Aug. 1, 1988

[51] Int. Cl.[4] ..... A47G 19/22

[52] U.S. Cl. ..... 215/100 A; 215/1 R; 220/94 A

[58] Field of Search ..... 215/100 R, 100 A, 6, 215/1 A; 220/94 A, 94 R; D7/9, 10

[56] References Cited

U.S. PATENT DOCUMENTS

| | | | |
|---|---|---|---|
| D. 37,168 | 10/1904 | Moller, Jr. . | |
| D. 148,580 | 2/1948 | Ross . | |
| D. 166,832 | 5/1952 | Thompson | 220/94 R X |
| D. 191,214 | 8/1961 | Fisher | D7/10 |
| D. 197,528 | 2/1964 | Carroll . | |
| D. 264,663 | 6/1982 | Ochwat . | |
| D. 279,752 | 7/1985 | Jagger | D7/10 |
| 1,674,452 | 6/1928 | Slick | 220/94 A |
| 1,934,156 | 11/1933 | Verderosa . | |
| 1,941,327 | 12/1933 | Turner | 215/6 |
| 2,057,047 | 10/1936 | Myer | 220/94 A |
| 2,586,199 | 2/1952 | Backus | 220/94 A |
| 2,661,609 | 12/1953 | Reuell | 220/94 A |
| 4,220,079 | 9/1980 | Sims | 215/1 R X |
| 4,557,392 | 12/1985 | Ryan et al. | 215/100 A X |

FOREIGN PATENT DOCUMENTS

| | | | |
|---|---|---|---|
| 7601681 | 8/1976 | Netherlands | 215/100 A |
| 264868 | 3/1928 | United Kingdom | 220/94 A |

OTHER PUBLICATIONS

Feeding Cup, The Vollrath Co., Health Care Division, 209 Vollrath Drive, P.O. Box 228, Gallaway, TN 38036, Medical Care Prod., 4/1988.

*Primary Examiner*—Sue A. Weaver

*Attorney, Agent, or Firm*—Peterson, Wicks, Nemer & Kamrath

[57] ABSTRACT

The receptacle is in the form of a cup having U-shaped handles extending laterally in opposite directions. The handles also incline upwardly and forwardly. Oriented with respect to the handles are two thumb rests that are engagable by the user's thumbs when the user's fingers are grasping the U-shaped handles. In this way, a handicapped person can firmly grasp the handles and thumb rests so as to manipulate the cup without assistance.

6 Claims, 1 Drawing Sheet

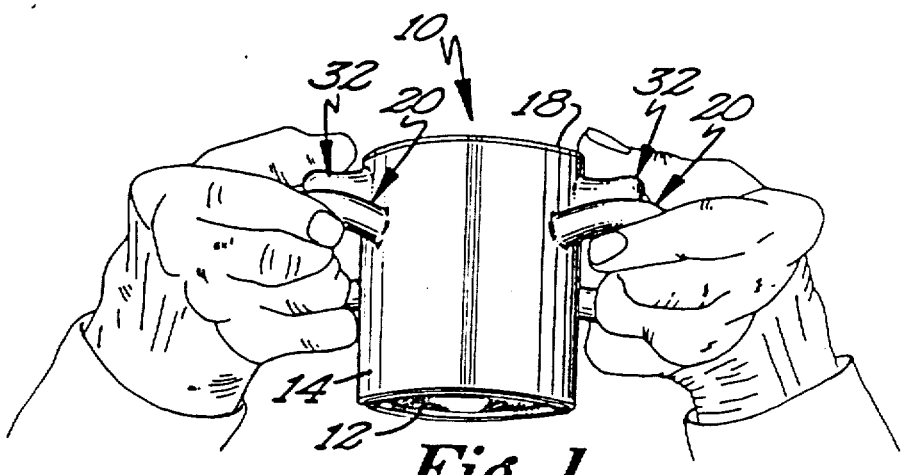

*Fig 1*